US007815525B2

(12) United States Patent
Small

(10) Patent No.: US 7,815,525 B2
(45) Date of Patent: Oct. 19, 2010

(54) TRACEABLE PLAYING BALL AND TRACKING SYSTEM FOR THE SAME

(76) Inventor: Calvin Small, 1729 Roosevelt St., Gary, IN (US) 46404

( * ) Notice: Subject to any disclaimer, the term of this patent is extended or adjusted under 35 U.S.C. 154(b) by 373 days.

(21) Appl. No.: 11/946,402

(22) Filed: Nov. 28, 2007

(65) Prior Publication Data

US 2009/0137340 A1 May 28, 2009

(51) Int. Cl.
*A63B 37/00* (2006.01)
*A63B 43/00* (2006.01)
*A63B 43/06* (2006.01)

(52) U.S. Cl. ..... 473/351; 463/30; 463/39; 463/40; 473/353

(58) Field of Classification Search ..... 423/349; 463/30, 39, 40; 473/349, 351, 353
See application file for complete search history.

(56) References Cited

U.S. PATENT DOCUMENTS

| | | | | |
|---|---|---|---|---|
| 3,840,699 | A * | 10/1974 | Bowerman | 348/169 |
| 5,768,151 | A * | 6/1998 | Lowy et al. | 463/2 |
| 2003/0054905 | A1 * | 3/2003 | King, Jr. | 473/467 |
| 2005/0101411 | A1 * | 5/2005 | Stiller et al. | 473/353 |

* cited by examiner

*Primary Examiner*—John M Hotaling, II
*Assistant Examiner*—Adetokunbo Torimiro
(74) *Attorney, Agent, or Firm*—Michael Ries

(57) ABSTRACT

Disclosed are a ball for use in a sporting activity, and a tracking system for tracking the ball. The ball comprises a microchip embedded in the ball. The microchip is adapted to transmit an information specific to a location of the ball to the tracking system. The tracking system is configured to locate the ball based on the information specific to the spatial location of the ball.

12 Claims, 5 Drawing Sheets

TRACEABLE PLAYING BALL AND TRACKING SYSTEM FOR THE SAME

FIELD OF THE INVENTION

The present invention relates generally to tracing objects, and more particularly, to tracing balls used in sport activities.

BACKGROUND OF THE INVENTION

At almost every place, for recreation or professional purposes, people are generally involved in many outdoor sporting activities including games such as golf, football, and baseball. Such typical activities generally involve playing with a ball and other equipment. During these activities, balls generally traverse from one place to another through the entire playground. Often, especially in the game of golf, the ball can get lost, causing players to spend a lot of time in searching for the ball after it has been hit by the club during play of the game.

There are existing tracking systems that keep a track of the balls during the sporting activity. A majority of these existing tracking systems use a variety of cameras to capture the movement of the ball during a game. Using cameras to consistently capture the movement of the ball during the game may be a costly affair. Further, the ball may land in an area that is not be in a capturing zone of the cameras. Again, a camera based tracking system is not an effective solution in unfavorable weather conditions such as fog, rain and the like.

Therefore, based on the foregoing, there is a need for a tracking system that is capable of tracking the ball used in a sport activity in a reliable manner in all weather conditions. Further, the tracking system should also be cost effective.

SUMMARY OF THE INVENTION

In view of the foregoing disadvantages inherent in the prior art, the general purpose of the present invention is to provide a traceable playing ball and a tracking system for locating the playing ball and configured to include all the advantages of the prior art, and to overcome the drawbacks inherent therein.

Therefore, an object of the present invention is to provide a ball that is capable of providing information specific to a spatial location of the ball to a tracking system.

It is another object of the present invention to provide a tracking system for locating a ball that is used in a sport activity.

In light of the above objects, in one aspect, the present invention provides a ball to be used in a sport activity. The ball comprises a microchip that is embedded in the ball. The microchip is adapted to transmit an information specific to a spatial location of the ball to a tracking system. The tracking system is configured to locate the ball based on the information specific to spatial location of the ball.

In another aspect, the present invention provides a tracking system for locating a ball to be used in a sport activity. The tracking system comprises a receiver configured to receive an information specific to a spatial location of the ball. The ball is configured to transmit the information specific to the spatial location of the ball. Further the tracking system comprises a processing module communicably coupled to the receiver for determining the location of the ball based on the information specific to the spatial location of the ball. Furthermore, the tracking system comprises a display mechanism for displaying the location of the ball determined by the processing module.

In yet another aspect, the present invention provides a method of tracking a ball during a sport activity. The method comprises receiving an information specific to a spatial location of the ball by a tracking system. The method further comprises determining a location of the ball based on the information of the spatial location of the ball at a receiver of the tracking system.

These together with other aspects of the present invention, along with the various features of novelty that characterize the present invention, are pointed out with particularity in the claims annexed hereto and form a part of the present invention. For a better understanding of the present invention, its operating advantages, and the specific objects attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE INVENTION

The exemplary embodiments described herein detail for illustrative purposes are subject to many variations in structure and design. It should be emphasized, however, that the present invention is not limited to a particular traceable ball and a tracking system, as shown and described. It is understood that various omissions and substitutions of equivalents are contemplated as circumstances may suggest or render expedient, but these are intended to cover the application or implementation without departing from the spirit or scope of the claims of the present invention.

The terms "a" and "an" herein do not denote a limitation of quantity, but rather denote the presence of at least one of the referenced item.

Figure 1:
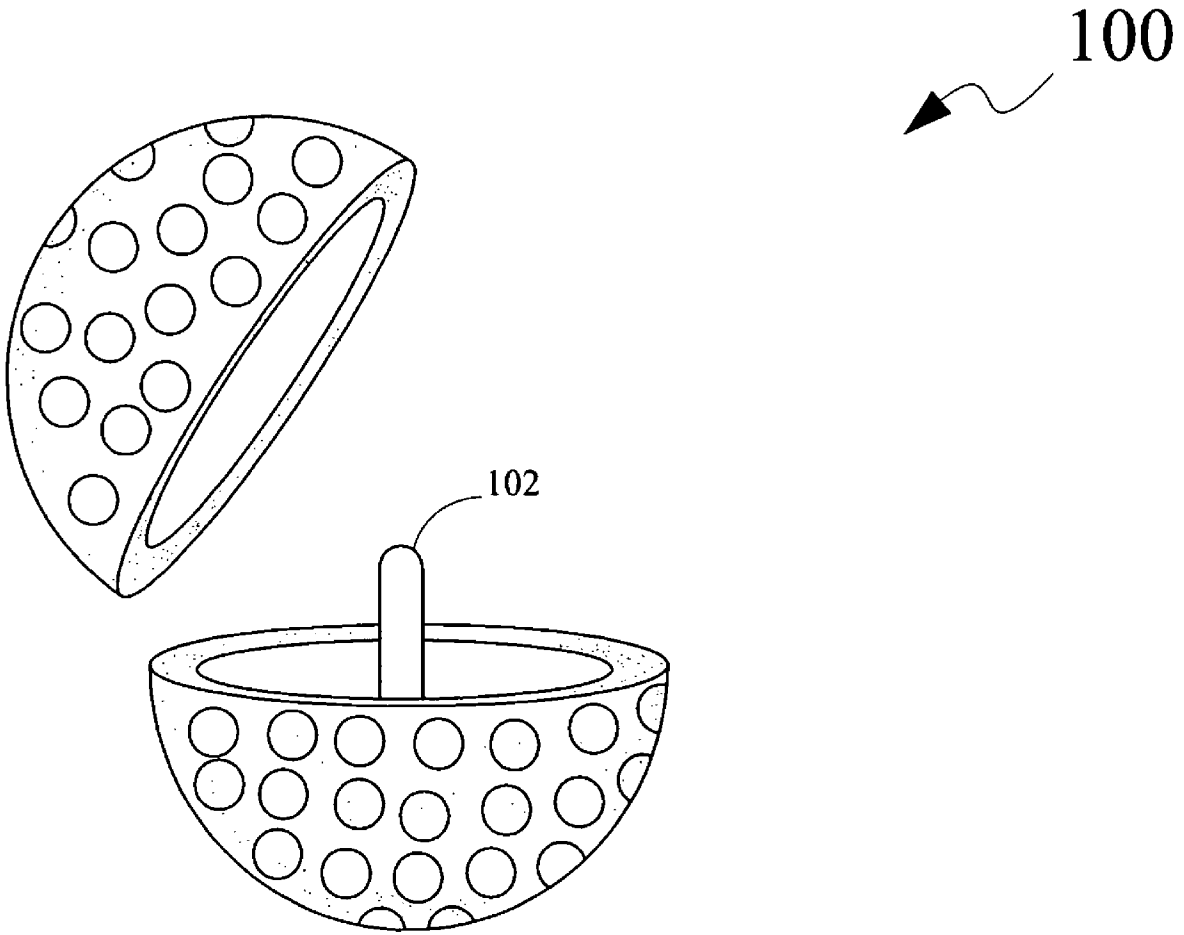
FIG. 1 is an exploded perspective view of a ball used in a sport activity, according to an exemplary embodiment of the present invention.

Referring to FIG. 1, an exploded perspective view of a ball 100 is shown, in accordance with an embodiment of the present invention. The ball 100 may be used in a sport activity. Herein, the sport activity preferably includes golf, but may also include games such as football, baseball, and the like. The ball 100 is represented in two halves, which is cut across the diameter of the ball 100. The ball 100 includes a microchip 102. As shown in FIG. 1, the microchip 102 is embedded inside the ball 100. In an embodiment of the present invention, the microchip 102 is embedded in the center of the ball 100 while manufacturing the ball 100 in order to make the microchip 102 shock resistant during the sport activity. However, the microchip 102 must not necessarily be embedded in the center of the ball 100, but the microchip 102 may also be embedded in other areas within the ball 100.

The microchip 102 is adapted to transmit an information specific to a spatial location of the ball 100 to a tracking system 200 (not shown in FIG. 1). The tracking system 200 is configured to locate the ball 100 based on the information specific to the spatial location of the ball 100. The tracking system 200 is described in detail in conjunction with FIGS. 2, 3A and 3B. The information specific to the spatial location of the ball 100 comprises at least one of a location of the ball 100 from the tracking system 200, distance from a reference point (for example, longest drive of the ball 100 from the reference point, a location of the ball 100 with respect to a particular hole in case of golf), elevation and slope of the ball 100, and other data that may assist in locating the ball 100.

Figure 2:
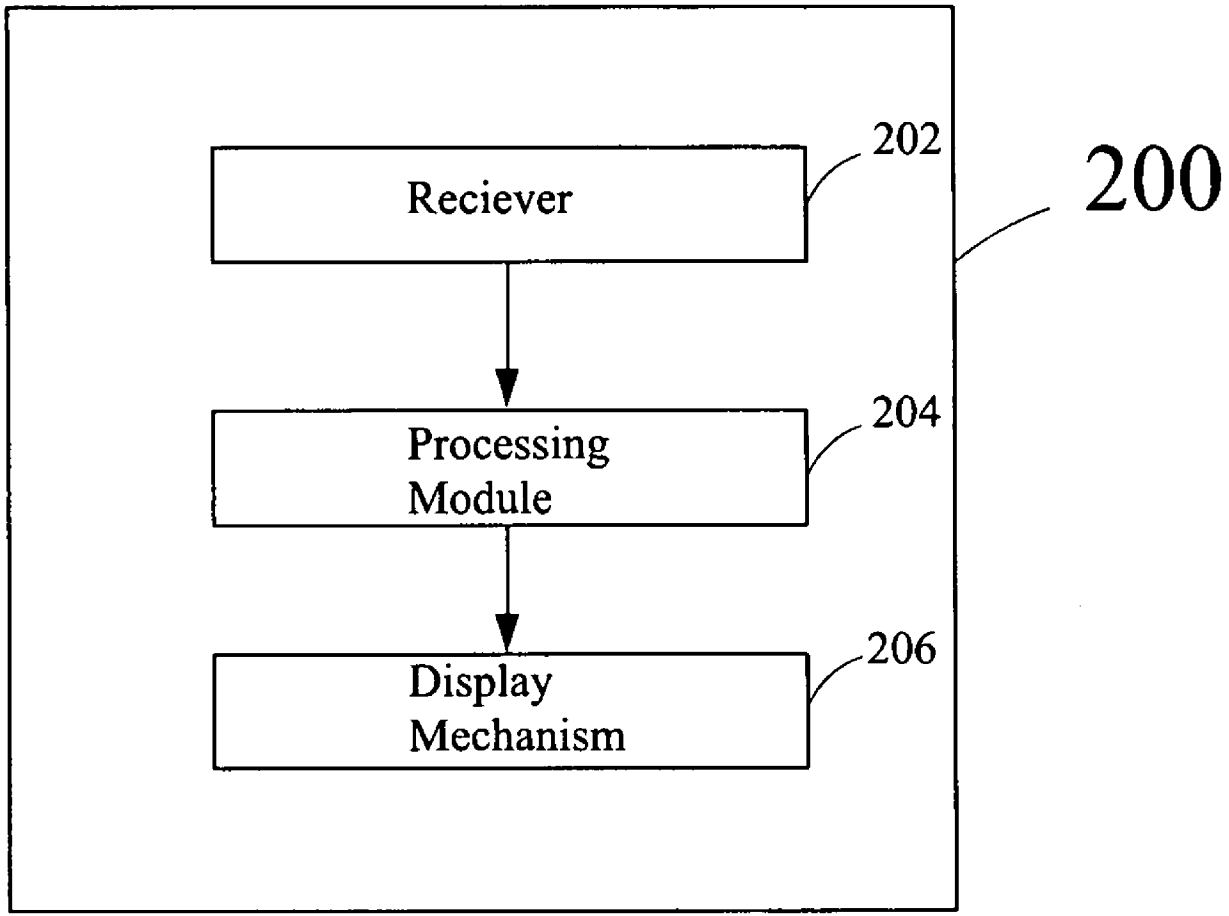
FIG. 2 is a block diagram of a tracking system, according to an exemplary embodiment of the present invention.

Referring now to FIG. 2, a block diagram illustrating various components of the tracking system 200 is shown, according to an exemplary embodiment of the present invention. The tracking system 200 may be a pocket size portable device, which may be attached with a belt of a player, placed in his/her pocket or may be placed in a sport kit. The tracking system 200 comprises a receiver 202, a processing module 204 and a display mechanism 206. The receiver 202 is configured to receive an information specific to the spatial location of the ball 100. As already explained in conjunction with FIG. 1, the ball 100 is configured to transmit the information specific to the spatial location of the ball 100.

The processing module 204 is communicably coupled to the receiver 202. The processing module 204 determines the location of the ball 100 based on the information specific to the spatial location of the ball 100. The display mechanism 206 displays the location of the ball 100 determined by the processing module 204. The location of the ball 100 may include, but is not limited to, a graphical display of the reference point, a landing position of the ball 100, textual display of the distance between the ball 100 and the reference point, and textual distance of the ball 100 from a person carrying the tracking system 200 during searching of the ball 100. The location of the ball 100 may further include slope and elevation of a landing position of the ball 100.

Figure 3A:
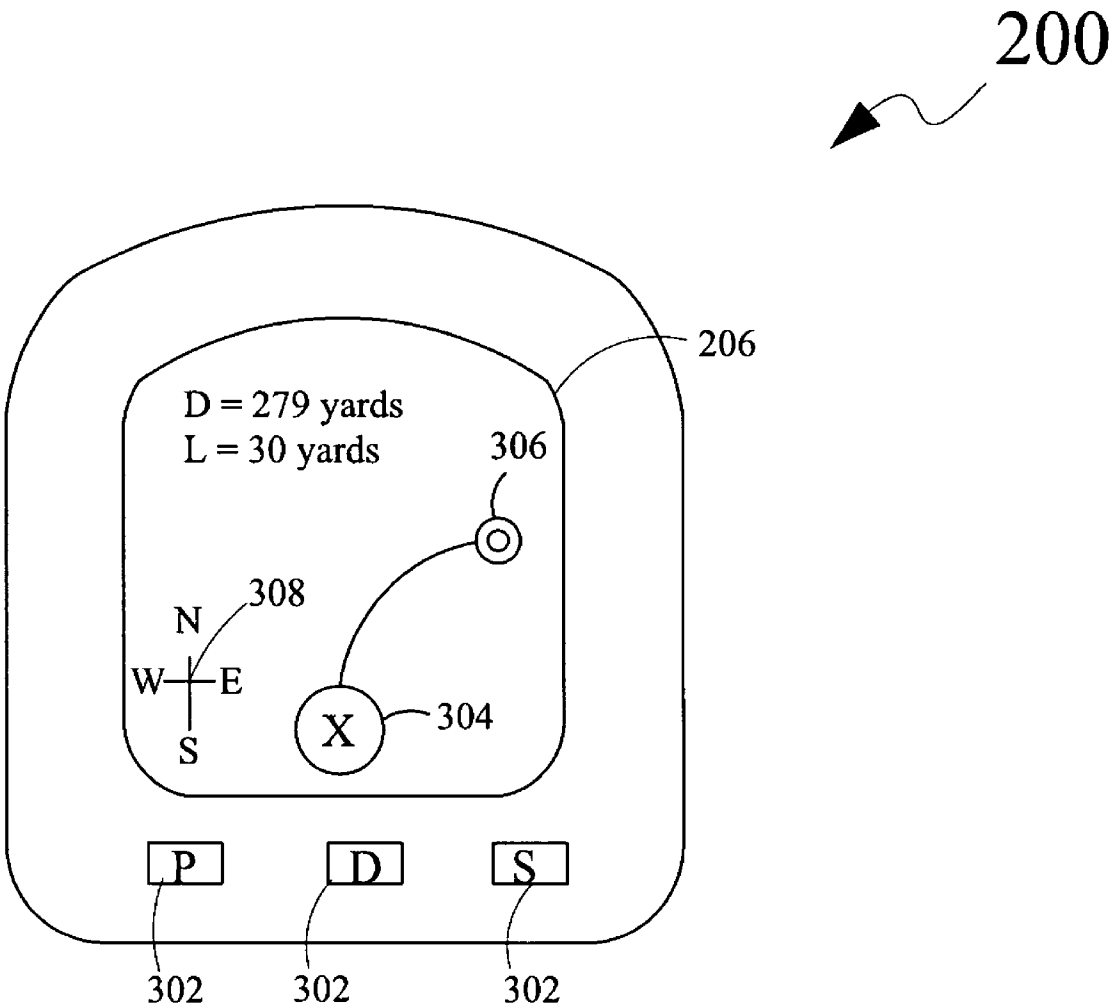
FIG. 3A is a front view of the tracking system, according to an exemplary embodiment of the present invention.
Figure 3B:
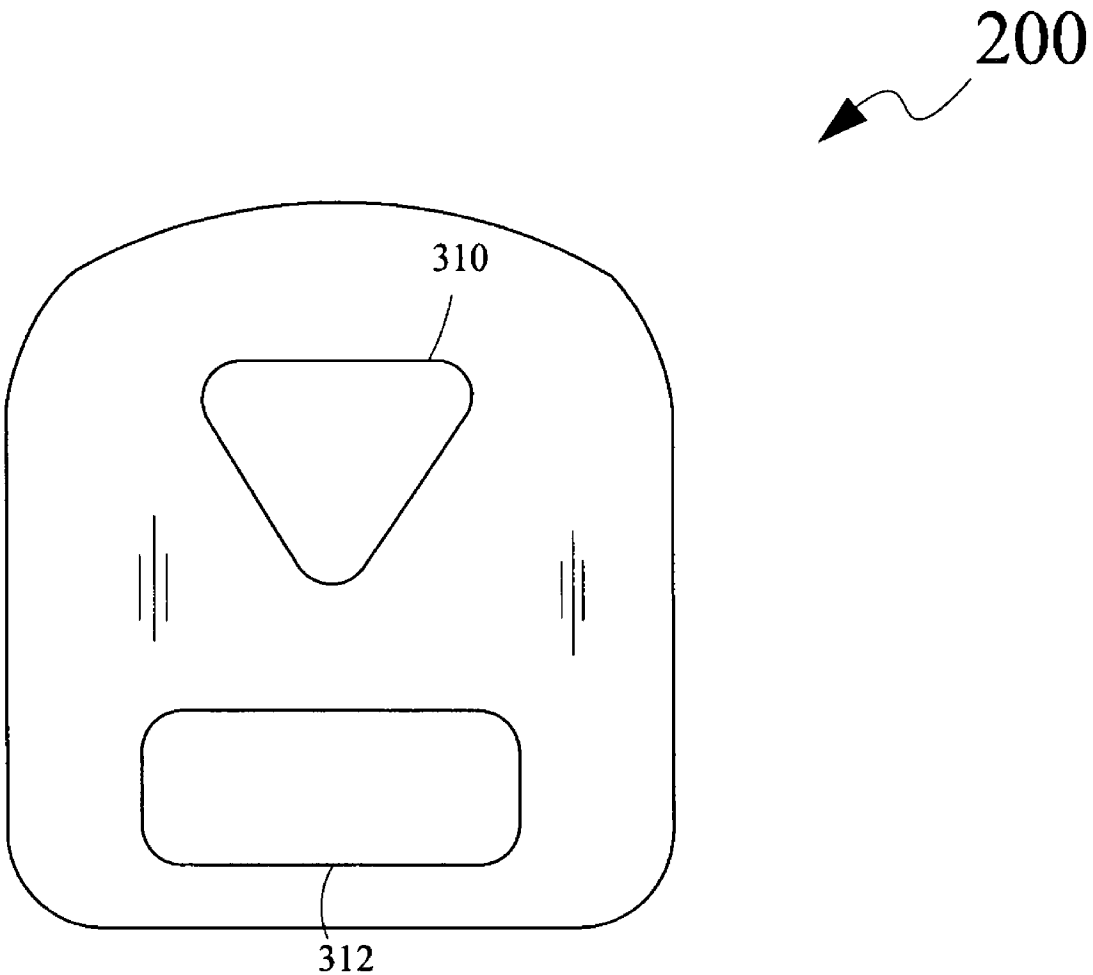
FIG. 3B is a rear view of the tracking system, according to an exemplary embodiment of the present invention.

Referring now to FIGS. 3A and 3B, the tracking system 200 is shown, according to an exemplary embodiment of the present invention. FIG. 3A represents a front view of the tracking system 200. The tracking system 200 further comprises at least one button, such as buttons 302, as shown in FIG. 3A. The buttons 302 facilitate a person in operation of the tracking system 200. More specifically, the buttons 302 are used to guide a display pattern at the display mechanism 206. An exemplary display pattern representing the location of the ball 100 is shown in FIG. 3A.

The button 302, represented by a letter 'P' thereon, represents power. By depressing the button 302 with alphabet 'P', the tracking system 200 may be powered 'ON' or 'OFF'. Further, the button 302, represented by a letter 'S', upon depressing, displays a distance between the ball 100 and the person carrying the tracking system 200 during the searching of the ball 100. Again, the button 302 represented by a letter 'D', when pressed displays the distance of the ball 100 from a reference point on the display mechanism 206. It will be apparent to a person skilled in the art that only three buttons 302 are shown for exemplary purposes and it should not be considered limiting.

As shown in FIG. 3A, the exemplary display pattern at the display mechanism 206 includes a reference position 304 (shown by a cross sign (X)), which represents a reference point, against which the distance and the direction of the ball 100 is determined. Further, the display pattern includes a landing position 306 (shown by a circle sign (O)), which represents a position, where the ball 100 has landed, on or off of a course or field of play. The display pattern also includes a compass 308 that represents directions north (N), south (S), east (E) and west (W). The direction of the ball 100 represented by the compass 308, and the distance of the ball 100 from the reference position 304 may assist a person in searching the ball 100.

In an embodiment of the present invention, the display mechanism 206 also represents a textual display of the distance D of the ball 100 from the reference position 304. The distance D represents a distance between the reference position 304 and the landing position 306. Further, the display pattern also includes a display of a current location L of the ball 100 from the tracking system 200, when the person is searching for the ball 100. For example, as shown in FIG. 3A, the distance D of the ball 100 from the reference position 304 is 279 yards. Further, the location L of the ball 100 represents the current distance of the ball 100 from the person carrying the tracking system 200, which is shown as 30 yards. The current location L of the ball 100 keeps changing, when the person is heading towards or away from the ball 100.

Referring now to FIG. 3B, a rear view of the tracking system 200 is shown, according to an exemplary embodiment of the present invention. The tracking system 200 optionally includes a clip 310, which is capable of being engaged with objects such as a belt of a player, pocket or clothes of the player. The tracking system 200 further includes a slot 312 capable of receiving at least one removable battery including, but not limited to, an AA battery for providing power to the tracking system 200.

Figure 4:
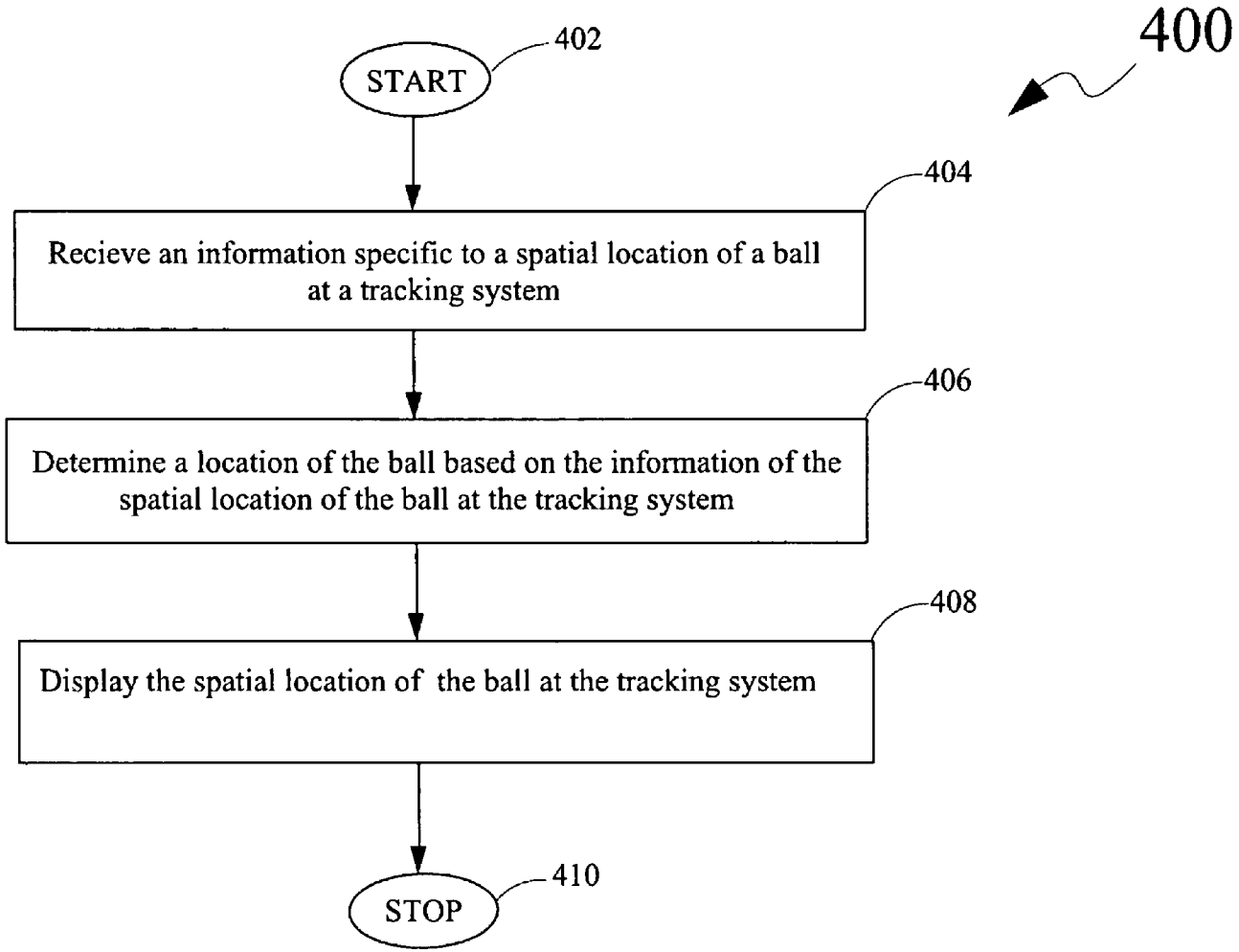
FIG. 4 is a flow diagram illustrating a method of locating a ball during a sport activity, according to an exemplary embodiment of the present invention.

Referring now to FIG. 4, a flow diagram 400 illustrating a method of locating a ball such as the ball 100 is shown, according to an exemplary embodiment of the present invention. The method is initiated at 402. At 404, an information specific to a spatial location of the ball 100 is received by a tracking system such as the tracking system 200. The information specific to the spatial location of the ball 100 comprises at least one of a location of the ball 100 from the tracking system 200, distance of the ball 100 from a reference point (for example, longest drive of the ball 100 from the reference point, a location of the ball 100 with respect to a particular hole in case of golf), elevation and slope of the ball 100, and other data that may assist in locating the ball 100.

Thereafter, at 406, the method includes determining a location of the ball 100 based on the information of the spatial location of the ball 100 at the tracking system 200. Furthermore, at 408, the method comprises displaying the spatial location of the ball 100 on a display mechanism such as the display mechanism 206 of the tracking system 200. Thereafter, the method of locating the ball 100 is terminated at 410.

Various embodiments of the present invention offer following advantages. The present invention provides a low cost tracking system, such as the tracking system 200 for locating a ball, such as the ball 100, which is used in a sport activity. Further, the working of the tracking system 200 does not depend upon factors such as weather conditions. Furthermore, the present disclosure provides an option of transmitting a variety of information specific to spatial location of the ball 100 to the tracking system 200 that may be used to locate the ball 100.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, and to thereby enable others skilled in the art to best utilize the present invention and various embodiments with various modifications as are suited to the particular use contemplated. It is understood that various omissions and substitutions of equivalents are contemplated as circumstances may suggest or render expedient, but these are intended to cover the application or implementation without departing from the spirit or scope of the claims of the present invention.

What is claimed is:

1. A ball for use in a sport activity, comprising:

a microchip embedded in the ball, the microchip adapted to transmit an information specific to a spatial location of the ball to a tracking system, wherein the tracking system is configured to locate the ball based on the information specific to the spatial location of the ball, and wherein the information specific to the spatial location of the ball includes slope of the ground on which the ball is located.

2. The ball of claim 1, wherein the information specific to the spatial location of the ball includes at least one of a location of the ball from the tracking system, distance from a reference point of the ball, and an elevation of the ball.

3. A tracking system for locating a ball used in a sport activity, the tracking system comprising:

a receiver configured to receive an information specific to a spatial location of the ball, wherein the ball is configured to transmit the information specific to the spatial location of the ball, wherein the information specific to the spatial location of the ball includes slope of the ground on which the ball is located;

a processing module communicably coupled to the receiver for determining the location of the ball based on the information specific to the spatial location of the ball; and a display mechanism for displaying the location of the ball determined by the processing module.

4. The tracking system of claim 3, further comprising:

at least one button for guiding a display pattern at the display mechanism; and a slot configured to receive a removable battery for charging the tracking system.

5. The tracking system of claim 3, wherein the information specific to the spatial location of the ball comprises at least one of a location of the ball from the tracking system, distance of the ball from a reference point, and an elevation of the ball.

6. A method of locating a ball during a sport activity, the method comprising:

receiving an information specific to a spatial location of the ball by a tracking system form the ball; and determining a location of the ball based on the information specific to the spatial location of the ball by the tracking system, wherein the information specific to the spatial location of the ball includes slope of the ground on which the ball is located.

7. The method of claim 6, further comprising displaying the location of the ball by the tracking system.

8. The method of claim 6, wherein the information specific to the spatial location of the ball comprises at least one of location of the ball from the tracking system, distance from a reference point, and elevation of the ball.

9. The method of claim 8, further comprising displaying the slope.

10. The method of claim 9, wherein the ball is a golf ball.

11. The method of claim 10, wherein the information specific to the spatial location of the ball includes distance from the ball to a particular hole on a golf course.

12. The system of claim 4, wherein the ball is a golf ball and the displaying system selectively displays the slope of the ground on which the ball is located and distance from the ball to a particular hole on a golf course.

* * * * *